US005108863A

United States Patent [19]

Hsieh et al.

[11] Patent Number: 5,108,863

[45] Date of Patent: Apr. 28, 1992

[54] PROCESSES FOR THE PREPARATION OF ENCAPSULATED TONER COMPOSITIONS

[75] Inventors: Bing R. Hsieh, Webster; Robert J. Gruber, Pittsford; Edul N. Dalal, Webster, all of N.Y.

[73] Assignee: Xerox Corporation, Stamford, Conn.

[21] Appl. No.: 363,577

[22] Filed: Jun. 8, 1989

[51] Int. Cl.[5] ..... G03G 9/00; G03G 5/00; G03C 1/72

[52] U.S. Cl. ..... 430/109; 430/111; 430/137; 430/138

[58] Field of Search ..... 430/138, 137, 109, 111, 430/110

[56] References Cited

U.S. PATENT DOCUMENTS

| | | | |
|---|---|---|---|
| 3,767,962 | 7/1976 | O'Malley | 90/15 D |
| 3,974,078 | 8/1976 | Crystal | 252/62.1 P |
| 4,148,741 | 4/1979 | Bayley | 252/62.1 P |
| 4,263,389 | 4/1981 | Ciccarelli | 430/106 |
| 4,613,559 | 9/1986 | Ober et al. | 430/137 |
| 4,656,111 | 4/1987 | Wakamiya et al. | 430/109 |
| 4,766,051 | 8/1988 | Breton et al. | 430/138 |
| 4,812,517 | 3/1989 | West | 525/309 X |
| 4,851,318 | 7/1989 | Hsieh et al. | 430/137 |

*Primary Examiner*—Marion E. McCamish
*Assistant Examiner*—Stephen C. Crossan
*Attorney, Agent, or Firm*—E. O. Palazzo

[57] ABSTRACT

A process for the preparation of encapsulated toner compositions which comprises a core dispersion obtained by adding pigment to a monomer, and wherein the pigment is sterically stabilized with a block copolymer; dispersing the resulting core dispersion into an aqueous solution containing an emulsifier; adding thereto an aqueous solution containing a shell monomer; encapsulating the core dispersion by interfacial polymerization of said shell monomer; and heating to initiate a free radical polymerization of the core monomer.

4 Claims, No Drawings

PROCESSES FOR THE PREPARATION OF ENCAPSULATED TONER COMPOSITIONS

BACKGROUND OF THE INVENTION

The present invention is generally directed to processes for the preparation of toner compositions, and more specifically the present invention is directed to toners and to processes for the preparation of encapsulated, especially colored encapsulated, toners wherein dispersing components are selected that, for example, enable passivation. Specifically, the present invention is directed to processes for the preparation of encapsulated toner compositions, especially encapsulated colored toners wherein block copolymers are selected as dispersants for the pigment particles, including colored pigments, and wherein the shells thereof can be obtained by interfacial polymerization, which shells are comprised of, for example, polyurethanes, polyesters, thermotropic liquid crystalline components as illustrated in U.S. Pat. No. 4,543,313, the disclosure of which is totally incorporated herein by reference, low melting polyesters, polyamides, and the like. In one embodiment of the present invention, the process comprises mixing pigment in the presence of a copolymer dispersant and an organic component; admixing the aformentioned mixture with shell monomers; dispersing the resulting mixture into an aqueous solution containing, for example, an optional emulsifier; and subsequently encapsulating the core comprised of pigment, dispersant and the liquid by accomplishing interfacial polymerization of the shell monomers with second shell monomers. In another embodiment of the present invention, particles are formed by dispersing a core component comprised of monomers, pigment, and a block copolymer dispersant into an aqueous solution containing an emulsifier, which particles can then be encapsulated by a polymeric shell as indicated herein. The toners illustrated herein can be prepared by an in situ process which comprises mixing pigment in the presence of a copolymer dispersant, and vinyl monomers; admixing the aforementioned mixture with shell monomers, preformed toner resins and radical initiators to form a homogeneous pigment dispersion comprised of both the shell and the core monomers, radical initiators, pigment, the preformed resins and the block copolymer dispersant; dispersing the mixture into an aqueous emulsifier solution to provide a suspension of pigmented droplets; subsequently encapsulating the core comprised of the pigment, the dispersant, the preformed resins and the vinyl monomers by accomplishing interfacial polymerization of the shell monomers with second shell monomers to obtain a stable suspension; heating the suspension to enable free radical suspension polymerization of the vinyl monomers to provide solid particles; and washing and drying the particles to yield the final toner product. The toner particles of an average volume diameter of from, for example, 5 to about 30 microns with narrow size distributions of from about 1.2 to 1.8 can be obtained, and classification is eliminated. The primary purpose of encapsulation is to passivate the pigment charging, that is the charging characteristics of the toner particles is ultimately controlled by that of the colorants, especially those exposed at the surfaces of the toner particles. Influence of the pigment charging can be prevented by encapsulation of various color particles with a common shell polymer of the desired charging properties. Therefore, developer charging, including triboelectric and admix characteristics, can be controlled and preselected with the process of the present invention. The copolymers selected as dispersants for the process of the present invention are nonionic dispersants and their adverse interference on the electirical properties of the toner composition is minimized and is less than when surfactant type ionic dispersants are utilized. The block dispersants possess an anchoring segment to enhance the attachment of the dispersant to the surface of a pigment particle and another segment, which is compatible with the selected toner resins, to provide steric stabilization. Block polymer dispersants selected for the processes of the present invention can thus provide superior dispersing, fluidization and anti-settling performance compared to conventional surfactants in nonaqueous systems as detailed in *Modern Paint and Coatings* 1985, 9, 32; *Journal of Coatings Technology* 1986, 58, 71; and *Coating Technology* 1986, 58, 71, the disclosures of which are totally incorporated herein by reference. The dispersants illustrated herein can also be selected for the preparation of toner compositions comprised of resin particles and pigment particles, reference, for example, U.S. Pat. No. 4,289,672, the disclosure of which is totally incorporated herein by reference. Advantages of the process of the present invention are as illustrated herein and include the enablement of high loadings, for example, from about 7 to about 15 weight percent of pigment particles with minimal agglomerates within the toner particles to ensure optimized copy quality on paper and transparencies. Also, there is provided with the present invention a process for the preparation of various color toners from laboratory scale (less than 1.0 kilogram) to large scale toner production (up to several hundred kilograms). The toner compositions of the present invention are useful for permitting the development of images in electrostatographic systems, inclusive of electrostatic imaging and printing processes, including color processes.

As a result of a patentability search, there were selected the following U.S. patents. U.S. Pat. No. 3,974,078 discloses the use of block copolymers as dispersing agents, which agents were not functioning as pigment dispersants as is the situation with the copolymers of the present invention. More specifically, there is disclosed in the '078 patent the preparation of toner particles having two incompatible toner resins, one of which is soft and the other of which is tough, by using block copolymers as the dispersing or compatibility agent, see for example column 4, lines 35 to 64, and column 5, line 32. The copolymers enable the preparation of toner particles with such morphology that the soft polymer is encapsulated in a matrix of the tough polymers in a plurality of discrete domains. There are disclosed in U.S. Pat. No. 4,613,559 block copolymers as a steric stabilizer in the preparation of toners; and U.S. Pat. No. 4,148,741 discloses block copolymers as a stabilizer for the preparation of unencapsulated toners by suspension or bead polymerization. The block copolymers selected for the '741 process were not pigment dispersants but water soluble copolymer surfactants, typically the copolymers of ethylene oxide and propylene oxide, which were used to stabilize pigmented polymer particles with a size ranging from 200 to 600 microns during the suspension polymerization. Further, in U.S. Pat. No. 3,967,962 there are disclosed block copolymers as toner resins, and U.S. Pat. No. 4,263,389 discloses vinyl pyrrolidone polymers as dispersants.

There are disclosed in Konishiroku Japanese Publications 60/198554 A2, 60/198555 A2, and Canon Japanese Publication 61/65260 A2 heat fusible encapsulated toner compositions in which the shell of the encapsulated toner is prepared by an overcoating process involving the use of an organic solvent and polymeric materials of high melting points with a sufficient glass transition temperature to provide good blocking properties for these compositions. In contrast to the processes disclosed in the Japanese publications, the shells of the present invention can be prepared by interfacial polymerization in a simplified continuous one step process wherein the core and the shell of the toner are simultaneously formulated, which process therefore is of lower cost, that is from about 15 to about 40 percent less than the aforementioned prior art processes.

With further reference to the prior art, there is disclosed in Japanese Publication 61/56352 A2 heat fusible encapsulated toner compositions with a core prepared by in situ free radical polymerization with an epoxy-urea shell of a very high melting temperature. These toners do not ordinarily possess low melting properties, that is they usually cannot be heat fixed with fusers set at temperatures as low as 120° C. In contrast, the toner compositions of the present invention can be used both in conventional heat fusing imaging systems wherein high melting materials with, for example, a softening point above 100° C. are required necessitating fuser temperatures of up to 180° C., and in low melt applications as the shell and the core can be formulated accordingly.

Additionally, there are disclosed in Japanese Publication 61/118758 A2, Japanese Publication 59/218460 A2, Japanese Publication 61/28957 A2, Japanese Publication 60/175057 A2, and Japanese Publication 60/166958 A2 heat fusible toner compositions prepared by suspension polymerization. Examples of patents illustrating colored photocapsule toners include U.S. Pat. Nos. 4,399,209; 4,482,624; 4,483,912 and 4,397,483. More specifically, the '483 patent illustrates encapsulated toner materials which have applications in very specific areas such as pressure sensitive recording paper. Capsules prepared for this application are usually coated on a substrate directly from the emulsion in which they are prepared and withstand with difficulties spray drying processes, a disadvantage alleviated with the toners prepared in accordance with the process of the present invention. Furthermore, these capsules contain an organic liquid in the core which, when used in a dry development system, could result in poor fix properties. Also, the range of particle sizes prepared by the aforementioned prior art process results in the formation of pressure sensitive recording particles which are usually not acceptable for electrostatographic development systems.

Moreover, there is described in U.S. Pat. No. 4,476,211, the disclosure of which is totally incorporated herein by reference, the preparation of electrostatographic toner materials with surface electroconductivity. Specifically, there is disclosed in the '211 patent a cold pressure fixable toner composition with polyamide, polyurea and other types of shell materials prepared by an interfacial polymerization process. The colorant selected for these compositions is generally comprised of a variety of dyes or pigments, and the core contains a polymeric material with a binder therein for retaining the colorant within the core and assisting in the fixing of the colorant onto the surface of a support medium. Examples of high boiling liquids selected for the process of the '211 patent include those boiling at temperatures higher than 180° C. such as phthalic esters, phosphoric acid esters, and alkyl naphthalenes.

Furthermore, there are disclosed in U.S. Pat. No. 4,307,169 microcapsular electrostatic marking particles containing a pressure fixable core, and an encapsulating substance comprised of a pressure rupturable shell, wherein the shell, such as a polyamide, is formed by an interfacial polymerization. Additionally, there are disclosed in U.S. Pat. No. 4,407,922, pressure sensitive toner compositions obtained by interfacial polymerization processes, and comprised of a blend of two immiscible polymers selected from the group consisting of certain polymers as a hard component, and polyoctyldecylvinylether-co-maleic anhydride as a soft component.

Also, there are illustrated in U.S. Pat. No. 4,543,313, the disclosure of which is totally incorporated herein by reference, toner compositions comprised of resin particles selected from the group consisting of thermotropic liquid crystalline polycarbonates, copolycarbonates, polyurethanes, polyesters, and copolyesters; and pigment particles. The aforementioned thermotropic liquid crystalline polymers, especially the polyesters and the polyurethanes, are useful as shells for the toner compositions of the present invention. However, the toner compositions of the '313 patent are not encapsulated and are prepared by conventional processes, such as melt blending and jetting.

There is also disclosed in copending application U.S. Ser. No. 043,265, now abandoned the disclosure of which is totally incorporated herein by reference, toner compositions comprised of core components, and thereover a thermotropic liquid crystalline polymeric shell formulated by interfacial polymerization. Further, in this copending application there is described black or colored toner compositions comprised of a polymer core or polymer mixtures, and pigment particles encapsulated in a shell formulated by interfacial polymerization processes, which shell is selected from the group consisting of thermotropic liquid crystalline polyesters, polycarbonates, polyurethanes, copolycarbonates, and copolyesters, reference U.S. Pat. No. 4,543,313. Therefore, in one specific embodiment of the aforementioned copending application the toner compositions are comprised of a polymer core having dispersed therein as pigments components selected from the group consisting of black, cyan, magenta, yellow, red, magnetites, and mixtures thereof; and thereover a thermotropic liquid crystalline polymeric shell. Also, additive particles in an amount of from about 0.1 percent by weight to about 1 percent by weight, such as colloidal silicas, inclusive of Aerosils and/or metal salts, or metal salts of fatty acids, inclusive of zinc stearate can be added to the formulated encapsulated toner. Moreover, there can be incorporated into the toner compositions of the copending application charge enhancing additives in an amount of from about 1 percent to about 20 percent by weight to enable positively charged toner compositions, which additives include alkyl pyridinium halides, reference U.S. Pat. No. 4,298,672, the disclosure of which is totally incorporated herein by reference; sulfate and sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and the like. Furthermore, there are provided in accordance with the copending application processes for the preparation of toner compositions wherein the shell component is obtained by interfacial polymerization.

In one preferred specific embodiment of the aforesaid copending application, there are illustrated toner compositions comprised of a core of (1) a pre-polymerized styrene-n-butylmethacrylate copolymer with a glass transition temperature of about 55° C. present in an amount of from about 1 percent by weight to about 30 percent by weight, and preferably from about 10 percent by weight to about 20 percent by weight, and an in situ polymerized styrene polymer present in an amount of from about 30 to about 50 percent by weight of the toner; and (2) a mixture of magnetite, from about 1 percent to about 60 percent by weight, and preferably from about 1 percent to about 30 percent by weight, and carbon black from about 2 percent to about 15 percent by weight, and preferably from about 3 to about 10 percent by weight, encapsulated with a polyester thermotropic liquid crystalline shell present in an amount of from about 10 percent to about 25 percent by weight. The resulting toner has a core/shell morphology with a shell thickness of from about 0.05 to about 1.0 micron. With further respect to the specific aforementioned compositions, there can be present in the core either carbon black or magnetite in an amount of from about 3 to about 8 percent, and from about 15 to about 20 percent, respectively.

Illustrated in a U.S. Pat. No. 4,758,506, the disclosure of which is totally incorporated herein by reference, are single component cold pressure fixable toner compositions, wherein the shell selected can be prepared by an interfacial polymerization process. A similar teaching is present in copending application U.S. patent Ser. No. 718,676 now abandoned relating to cold pressure fixable toners, the disclosure of which is totally incorporated herein by reference. In the aforementioned application, the core can be comprised of magnetite and a polyisobutylene of a specific molecular weight encapsulated in a polymeric shell material generated by an interfacial polymerization process.

Disclosed in copending application U.S. Ser. No. 416,071, are encapsulated toner compositions and processes thereof, and more specifically encapsulated toner compositions comprised of a core comprised of pigments, dyes or mixtures thereof, and a polymer; and wherein the core is encapsulated in a polyester shell with functional groups thereon derived from a diacid halide terminated polyester component. In this copending application some of the same polyester shells are utilized as selected for the encapsulated toners of the present invention, see the working Examples.

Primarily of background interest are the articles "Use of A-13 Black Polymers As Dispersants For Nonaqueous Coating Systems", H. L. Jakubauskus, *Coating Technology*, 58,71 1986; and "Improving Dispersion of Organic Pigments", T. Vernandukis, *Modern Print and Coatings*, 1985, 9 and 32, the disclosures of which are totally incorporated herein by reference.

SUMMARY OF THE INVENTION

It is an object of the present invention to provide processes for the preparation of toners, especially encapsulated toners with many of the advantages illustrated herein.

It is also an object of the present invention to provide toners and processes for encapsulated colored compositions comprised of a core with pigment and a block copolymer pigment dispersant encapsulated with polymers as indicated herein including condensation polymer shells formulated by an interfacial polymerization process.

Still another object of the present invention is to provide improved toner compositions with maximized pigment loadings, especially for color toners.

In another object of the present invention there are provided processes for encapsulated toner compositions with shells formulated by an interfacial polymerization process.

Also, in a further object of the present invention there are provided encapsulated toners with low melting characteristics.

Further, an additional object of the present invention resides in encapsulated black or colored toner compositions formulated by interfacial polymerization processes, and wherein pigment agglomeration is eliminated or minimized by block copolymer dispersants.

An additional object of the present invention resides in the provision of encapsulated toners that permit fuser life extension and improve wear resistance thereof in view of, for example, the lower fixing temperatures that can be selected for the toners obtained, and the selection of lower fusing energies, that is from about 25 to 50 percent, and preferably between 25 and 35 percent lower as compared to several known encapsulated toner compositions.

A further additional object of the present invention resides in the provision of processes for encapsulated toners with shells that withstand undesirable abrasions during processing and shipping.

Another object of the present invention is to provide economical and simple processes for the preparation of high quality pigment dispersions for in situ toner particle formation, reduced toner pile height, small size diameter toners with narrow size distribution, and toners with improved color properties and excellent overall print characteristics.

Also, another object of the present invention resides in the preparation of encapsulated toners from high quality pigment dispersions wherein the individual pigment primary particle or small pigment aggregate is sterically stabilized with the block copolymers. Stable pigment dispersion with high pigment loading as high as 50 weight percent, and with improved rheological properties such as reduced viscosities can be obtained with the aforementioned toners.

In another object of the present invention there are provided processes for the preparation of toner compositions containing core components such as pigment, copolymer dispersants and toner resins and the condensation polymer shells as illustrated in U.S. Pat. No. 4,543,313, which toners are useful in electrophotographic imaging and printing processes.

In another object of the present invention there are provided developer compositions formulated by admixing carrier particles with the toner compositions obtained by the processes illustrated herein.

These and other objects of the present invention are accomplished by the provision of toners and processes for the preparation of toner compositions. More specifically, the present invention is directed to processes for the preparation of encapsulated toner compositions which comprises dispersing of pigment into a core solution containing a monomer, and wherein a block copolymer is selected as a dispersant for the pigment; thereafter dispersing the pigmented core components into an aqueous solution containing an emulsifier, and subsequently encapsulating the core components by polymerization. In one specific embodiment, the process of the present invention comprises mixing 20 to 50 parts of a pigment and 75 to 25 parts of vinyl monomers in the presence of 5 to 25 parts of a copolymer dispersant in an attritor for 8 to 24 hours at room temperature; admixing 50 to 70 parts of the aforementioned mixture with 5 to 25 parts of shell monomers, 10 to 30 parts of preformed toner resins and 2 to 5 parts of radical initiators with a wrist action shaker or a roll mill for 30 minutes to form a homogeneous pigment dispersion; dispersing 10 to 20 parts of the dispersion into 50 to 200 parts of an aqueous emulsifier solution at 5° to 25° C. with a Brinkman homogenizer at 5,000 to 10,000 rpm for 15 seconds to 5 minutes to provide a suspension of pigmented droplets; subsequently encapsulating the core comprised of the pigment, the dispersant, the preformed resins and the vinyl monomers by accomplishing interfacial polymerization of the shell monomers with effective amounts of second shell monomers to obtain a stable suspension; adding to the suspension 50 to 100 parts of a protective colloid solution; heating the suspension at 70° to 75° C. for 15 to 24 hours and then at 85° to 90° C. for 5 to 10 hours to accomplish free radical suspension polymerization of the vinyl monomers and to provide encapsulated toner particles; washing the particles repeatedly with deionized water (10 to 20 times with 3 to 4 liters of water); and then spray drying the washed particles with a Yamato DL-41 spray dryer at an inlet temperature of 125° to 130° C. to provide 50 to 80 percent yields of final toner product in this embodiment of the present invention.

Further embodiments of the present invention include a process for the preparation of encapsulated toner compositions which comprises a core dispersion obtained by adding pigment to a monomer, and wherein the pigment is sterically stabilized with a block copolymer of an average molecular weight of from about 3,000 to about 100,000; dispersing the core dispersion into an aqueous solution containing an emulsifier; adding thereto an aqueous solution containing a shell monomer; encapsulating the core dispersion by accomplishing interfacial polymerization of said shell monomer, and heating component to initiate a free radical polymerization of the core monomer; a process for the preparation of encapsulated toner compositions which comprises (1) providing a core comprised of monomers capable of being polymerized by free radical polymerization, a colorant or pigment dispersed in an AB type diblock copolymer, or an ABA type triblock copolymer or a BAB type triblock copolymer, wherein A represents a pigment anchoring segment which interacts with the surfaces of the pigment particles and B represents a stabilizing group which is compatible with the core resin, and a free radical initiator, a polymer and an oil soluble shell monomer or monomers (2) dispersing said core components in an aqueous phase containing an emulsifier, an optional surfactant, an optional antifoaming agent, and an optional phase transfer agent; (3) adding a water soluble shell monomer or monomers; (4) encapsulating the core components by accomplishing interfacial copolymerization of the shell monomers; and (5) heating the aqueous suspension of the encapsulated particles thereby effecting in situ polymerization of the core monomers; and a process for the preparation of encapsulated toner compositions, which comprises (a) providing a core comprised of monomers capable of being polymerized by free radical polymerization, a colorant or pigment excluding black, and wherein the pigment is dispersed in a block copolymer, a free radical initiator, a prepolymer and an oil soluble shell monomer dissolved in the core dispersed in a block copolymer; (b) dispersing said core components in an aqueous phase containing an emulsifier, an antifoaming agent, and a phase transfer agent; (c) adding a second shell monomer which is water soluble to the aqueous phase; (d) encapsulating the core components by accomplishing interfacial polymerization of the oil and water soluble shell monomers; (e) adding a protective colloid, or emulsifier solution; (f) heating thereby effecting polymerization of the core monomers; (g) washing the toner product with deionized water; and (h) drying the washed toner product.

Illustrative examples of dispersants or polymer stabilizing components selected for the process of the present invention, and present in an amount of, for example, from about 1 to about 50 weight percent of the pigment include commercially available block copolymers, such as Solsperse hyperdispersants, available from ICI; Disperbyk, available from Byk-Chemie; Elvacite AB dispersants available from E.I. DuPont, which block copolymers are acylic based materials and believed to possess an average number molecular weight of from about 3,000 to about 10,000 with polydispersity of about 2 to 5; block polymers based upon various acrylates, methacrylates and vinyl monomers such as styrene, vinyl acetate, acrylonitrile and the like, available from E.I. DuPont. The structures of the block polymers are typically believed to be AB diblock, ABA or BAB triblock where A represents an anchoring segment which can attach strongly on the surfaces of pigment particles and B is a segment which is compatible with the core polymer of the toner particles. Another class of readily available AB block polymers can be prepared by reacting caprolactone or an acid chloride or isocyano terminated oligomer with a hydroxy terminated vinyl or condensation oligomer. Specific examples include block copolymers of styrene and caprolactone, block polymers of caprolactone and styrene/butyl methacrylate block copolymers of bisphenol polyester and styrene, block copolymers of bisphenol polyester and butyl methacrylate, and the like.

In another specific embodiment of the present invention, encapsulated toners are prepared by providing a core comprised of colorants or pigment particles dispersed in a core monomer, or monomers and in the block copolymers illustrated herein; providing a shell monomer, and a free radical initiator; dispersing the core components in water containing a surfactant, an antifoaming agent, and a phase transfer agent; effecting shell polymerization; and polymerizing the core monomer or monomers by heating wherein the polymeric shell and core resulting from the polymerization possess many of the advantages illustrated herein including excellent desirable core release characteristics from the shells upon heating and fusing onto paper at 60° to 140° C. and preferably between 80° to 100° C., and/or pigment passivation in this embodiment of the present invention.

The present invention in another specific embodiment is directed to a process for the preparation of colored encapsulated toner compositions which comprises (1) providing a core comprised of monomers capable of being polymerized by free radical polymerization, preformed toner resins, radial initiators, shell monomers, a colorant or pigment, such as cyan, magenta, yellow, red, blue, green, brown, black, mixtures thereof, and the like, wherein the pigment is well dispersed in the presence of a block copolymer such as Elvacite AB, an acrylic based component of an average molecular weight, it is believed, of about 10,000 available from E.I. DuPont Company; (2) dispersing said core components in an aqueous phase containing an emulsifier, an optional protective colloid, an optional surfactant, and an optional antifoaming agent; (3) encapsulating the core components by interfacial polymerization of the shell monomers with a second shell monomer or monomers; (4) heating the encapsulated particle suspension, after the addition of a protective colloid or emulsifier solution, to effect free radical polymerization of the core monomers; (5) washing the resulting encapsulated toner particles with deionized water; and (6) drying the particles by spraying or freezing method to give the final product.

Another embodiment of the present invention is directed to a process for the preparation of encapsulated toner compositions which comprises (1) providing a core comprised of monomers capable of being polymerized by free radical polymerization, with a colorant or pigment dispersed by the aid of a block copolymer illustrated herein thereby, for example, minimizing or eliminating undersirable pigment agglomeration, a free radical initiator, a polymer and a first shell monomer dissolved in the core monomers; (2) dispersing said core components in an aqueous phase containing a surfactant, an antifoaming agent, and a phase transfer agent; (3) adding a second shell monomer to the aqueous phase; (4) encapsulating the core components by accomplishing polymerization of the first and second shell monomers; (5) heating the aqueous suspension thereby effecting in situ polymerization of the core monomers; (6) washing the encapsulated toner particles with water; and (7) drying the toner particles by means of a spray or freezer drier. Toner particles with small average volume diameters, 6 to 15 microns, and high pigment loadings can be obtained and used to produce high quality prints with reduced toner pile heights and excellent projection efficiency.

Toners containing different colorants can thus be encapsulated with a common shell polymer with the processes of the present invention. Also, the influence of the pigments on the charging characteristics of the toner particles can be minimized, eliminated or passivated by the shell polymer with the processes of the present invention.

Toners obtained by the processes of the present invention can be comprised of core components, and thereover a polymeric shell as indicated herein including condensation polymers which can be formulated by interfacial polymerization. The shell polymers can be semicrystalline, amorphous or liquid crystalline with acceptable glass transition temperatures. The thickness of the shells are from 0.01 to 1.0 micron. The core materials are released during heat fusing on paper or transparencies to provide excellent fixing properties. Further, in accordance with the present invention there are provided colored toner compositions comprised of a polymer core or polymer mixtures, and pigment particles encapsulated in a shell formulated by interfacial polymerization processes, which shell is heat fusible and is selected, for example, from the group consisting of thermotropic liquid crystalline polyesters, polycarbonates, polyurethanes, polyamides, polyureas copolycarbonates, and copolyesters, reference U.S. Pat. No. 4,543,313, the disclosure of which is totally incorporated herein by reference. Therefore, in one specific embodiment of the present invention the toner compositions formed are comprised of a polymer core having dispersed therein as passivated pigment components selected from the group consisting of cyan, magenta, yellow, red, and mixtures thereof, which pigments are dispersed in core monomers by the aid of a block copolymer as illustrated herein; a shell; and a preformed toner resin or a combination of several resins such as copolymers of styrene and various methacrylates, copolymers of styrene and butadiene, polyesters and the like to enhance the fusing latitude of the encapsulated toners and the stability of the toner particles during fabrication process. Also, additive particles in an amount of from about 0.1 percent by weight to about 1 percent by weight, such as colloidal silicas, inclusive of Aerosils and/or metal salts, or metal salts of fatty acids, inclusive of zinc stearate can be added to the formulated encapsulated toner. Moreover, there can be incorporated into or added to the toner compositions of the present invention charge enhancing additives in an amount of from about 0.5 percent to about 20 percent by weight, and preferably from about 0.5 percent to about 5 percent by weight to enable positively charged toner compositions, which additives include alkyl pyridinium halides, reference U.S. Pat. No. 4,298,672, the disclosure of which is totally incorporated herein by reference; sulfate and sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and the like. Furthermore, there are provided in accordance with the present invention processes for the preparation of compositions wherein the shell component, which is obtained by interfacial polymerization, possesses the characteristics illustrated herein.

One specific embodiment of the present invention relates to processes for obtaining toner compositions comprised of a core of (1) a styrene-n-butylmethacrylate component in an amount of from about 1 percent by weight to about 30 percent by weight, and preferably from about 10 percent by weight to about 20 percent by weight with a glass transition temperature of about 55° C. present and an in situ polymerized n-butyl methacrylate polymer present in an amount of from about 30 to about 50 percent by weight of the toner, and preferably from about 3 to about 10 percent by weight, which pigment is dispersed in the mixture of the above components in the presence of the block copolymer Elvacite AB, the block copolymer being present in an amount of from about 2 to about 15 weight percent of the pigment encapsulated with a condensation polymer shell present in amount of from 1 percent to about 25 percent by weight of the toner and preferably from about 10 percent to about 25 percent by weight. The resulting toner has a core/shell morphology with a shell thickness of from about 0.01 to about 1.0 micron, with further respect to the specific aforementioned compositions, there can be present in the core either carbon black or magnetite in an amount of from about 3 to about 8 percent, and from about 15 to about 20 percent by weight, respectively.

Various specific suitable monomers, or mixtures, which mixtures contain, for example, from about 10 percent to about 90 percent by weight of a first monomer and from about 90 percent to about 10 percent by weight of a second monomer in an amount of from about 10 percent to about 85 percent by weight, and preferably from about 30 percent to about 75 percent by weight can be selected for incorporation into the core of the toner compositions of the present invention. Also, three or more monomers may be selected for use in some embodiments of the present invention. Illustrative specific examples of monomers include styrenes, methacrylates, acrylates, polyolefins, mixtures thereof, and the like. Examples of specific core polymer components resulting from the polymerization of monomers include copolymers of styrene and methylmethacrylates; styrene and methylacrylates; styrene and butadiene with a styrene content of greater than about 75 percent by weight; styrene n-butylmethylacrylate copolymers; styrene n-lauryl methacrylate and the like, including terpolymers of the above. In a preferred embodiment of the present invention, the polymer and/or copolymer core is prepared in situ by free radical polymerization processes in the presence of the selected combination of a pigment and a block polymer. Other polymers or mixtures thereof can be selected for the core providing the objectives of the present invention are achieved.

By in situ free radical polymerization processes as illustrated herein is meant, for example, a process in which the radically polymerizable monomers present in the organic phase are polymerized following the encapsulation of the organic phase. The in situ free radical polymerizations are initiated with azo type initiators present in an amount of from about 0.01 to about 2 percent by weight of the monomer selected. Examples of preferred initiators are 2,2' azo-bis-isobutyronitrile, 2,2' azo-bis-2,4-dimethyl-valeronitrile, and Vazo® commercially available from E.I. DuPont Corporation. Also, mixtures of initiators can be selected in an amount that will permit a core polymer with molecular and physical characteristics suitable for use as toner compositions. Examples of other initiators include those available from Pennwalt Corporation such as Lupersol®, Lucidol®, Luperco®, Alperox® and Decanox®. Control of polymerization rates and molecular weight is achievable through the use of difunctional or polyfunctional initiators in conjunction with an appropriate time-temperature profile for the polymerization reactions. Furthermore, diacyl peroxides can also be selected as initiators providing they are active at temperatures below 100° C. for the processes of in situ polymerization described therein.

Examples of core pigments or colorants that can be dispersed in the block copolymer and/or other core components, and present in various effective amounts of, for example, from about 3 to 70 percent by weight include carbon black, magnetites, and mixtures thereof; magenta, yellow, cyan, or mixtures thereof; red, blue, green, and brown pigments, or mixtures thereof. Specific examples of pigments present in an amount of from about 5 to about 25 percent by weight in the toner include Heliogen Blue L6900, D6840, D7020, Sudan Blue OS available from BASF, Pylam Oil Yellow, Pigment Blue 1 available from Paul Uhlich & Company Inc., Pigment Violet 1, and Pigment Red 48, also available from Uhlich & Company Inc., Lemon Chrome Yellow DCC 1026, and Bon Red C available from Dominion Color Corporation, Ltd., Toronto, Ontario, NOVAperm yellow FGL, Hostaperm Pink E available from Hoechst, Cinquasia Magenta available from E.I. DuPont de Nemours & Company, chrome pigments, molybdate orange, benzidine yellow, the Hansa yellows, tartrazine lakes, cadmium yellows and oranges, zinc yellow, red lead, lithol reds, toluidine reds, Alizarine pigments, B.O.N. Maroon, tungstated rhodamines, Fire red pigments, Helio bordeaux reds and Watchung red. Also, as a substitute for the pigments there can be selected rubber based printing inks available from Canadian Fine Color Company, which inks are believed to be comprised of a polymer, and certain unknown inexpensive pigments.

In addition, there can be selected in place of the disclosed pigments, dyes such as Oil Blue A, Passaic Oil Green, Sudan Red, Sudan Yellow 146, DuPont Oil Blue A, Passaic Oil Red 2144, Oil Yellow, Sudan Red 7B, Oil Pink 312, Pylachrome Pink LX1900, Sudan Black B, Ceres Blue R, Sudan Deep Black, and Ceres Black BN. The dye is usually present in the core in the amount of from about 1 percent to about 40 percent by weight, and preferably in an amount of from about 15 percent by weight to about 25 percent by weight.

The core may further contain additives in an amount of from 1 percent to about 40 percent by weight, and preferably in an amount of from about 1 to about 15 percent by weight such as metallic soaps, waxes, silicone derivatives and/or other releasing agents, that is additives which reduce adhesion of the final toner to the fuser roll in, for example, xerographic imaging and printing apparatuses including metal salts of fatty acids such as zinc stearate. Moreover, subsequent to encapsulation the toner compositions of the present invention can have added thereto as surface components to, for example, improve the toner flow properties and to control the electrical properties. These components, which are present in amounts of, for example, from about 0.1 percent to about 5 percent by weight, include colloidal silicas, such as Aerosil R972 and metal salts, and/or metal salts of fatty acids, reference U.S. Pat. Nos. 3,590,000; 3,655,374; 3,900,588 and 3,983,045, the disclosures of which are totally incorporated herein by reference.

As shell component examples present in an effective amount, for example in one embodiment from about 5 percent to about 25 percent by weight, there can be selected, for example, condensation polymers illustrated herein, or other low melting shells melting at temperatures lower than or equal to about 140° C. and preferably lower than or equal to about 120° C., and higher than 60° C. and preferably higher than 80° C. such as polyureas, polyamides, polyesters, polyesteramides, polyurethanes, and the like, which polymers are formulated by interfacial polymerization. Interfacial polymerization processes selected for the shell formation are as illustrated, for example, in U.S. Pat. Nos. 4,000,087; 4,307,169 and 3,429,827, the disclosures of which are totally incorporated herein by reference. There are illustrated in U.S. Pat. No. 4,543,313, the disclosure of which is totally incorporated herein by reference, examples of shell monomers which can be selected as the thermotropic liquid crystalline shells for the compositions obtained by the process of the present invention. Specific examples of shells include thermotropic liquid crystalline polycarbonates, copolycarbonates, polyurethanes, polyesters, and copolyesters. In a preferred embodiment of the present invention, terephthaloyl chloride, azeloyl chloride, sebacoyl chloride, and other aliphatic and aromatic diacid chlorides can be selected as the first shell monomers, which are present in the pigment dispersions; second monomers can be selected from di(p-hydroxy methyl phenyl) terephthalate, p,p'-biphenol, bisphenols, resorcinols, hydroquinones aliphatic diamines, the derivatives thereof, and the like.

Also, for the primary purpose of controlling the particle size of the particles or toners prepared by the process of the present invention, it is preferred to select a surfactant or a mixture of surfactants. The surfactants also assist in stabilizing the particles during the in situ polymerization phase and prevents or minimizes aggregations of the particles. Examples of surfactants present in an effective amount of, for example, from about 0.05 percent to about 3 percent by weight of the aqueous phase, and preferably from about 0.05 percent to about 1 percent by weight include both ionic and nonionic surfactants, such as polyvinylalcohol, polyethylene sulfonic acid salt, carboxylated polyvinylalcohol, water soluble block copolymers such as the Pluronics® and Tetronics® commercially available from BASF, cellulose derivatives such as hydroxypropyl cellulose, hydroxyethyl cellulose and the like; and inorganic sufactants such as trisodium polyphosphate, tricalcium polyphosphate, and the like. Lignosulfonate and polyelectrolyte dispersants can also be used, including those available from W. R. Grace as Daxad.

For the process of the present invention emulsifier, the aqueous phase may contain, in addition to the surfactant or mixture of surfactants disclosed herein, an antifoaming agent such as aliphatic alcohols, preferably containing from about 8 to about 15 carbon atoms or more, providing the alcohol is at least partially soluble in water, such as 2-decanol, which alcohol is present, for example, in an amount of from 0.01 percent to about 0.5 percent by weight and preferably from 0.01 percent to 0.1 percent by weight. The primary function of the alcohol is to control foaming during the dispersion of the monomer mixture into the water mixture. As a phase transfer agent, or components selected for the primary purposes of modification of the kinetics of the interfacial polymerization, the kinetics of shell formation, controlling the yield of polymer shell formation, and molecular dispersion and present in an effective amount of from, for example, about 0.001 to about 1 percent by weight of the aqueous phase, and preferably between 0.01 and 0.5 percent by weight there is mentioned (1) ammonium salts such as benzyl triethyl ammonium chloride, benzyl triethyl ammonium bromide or other alkylated ammonium salts such as tetraethyl ammonium salts, and the like; (2) crown ethers or cryptate type phase transfer agents such as benzo-18-crown-6, and the like. Other phase transfer agents that may be selected are illustrated in a compendium on phase transfer reactions, Georg Thieme Verlag Stuttgart, New York, 1986, the disclosure of which is totally incorporated herein by reference. The aqueous phase may also contain a free radical polymerization inhibitor in, for example, an effective amount such as from about 0.01 percent to about 1.0 percent by weight, and preferably from 0.01 percent to 0.1 percent by weight, such as alkali metal halides including potassium iodide, potassium chloride, and the like; and a base component such as potassium hydroxide or sodium hydroxide, and the like providing that the objectives of the present invention are achievable.

One preferred method for the preparation of the encapsulated toner compositions of the present invention comprises (1) dissolving 1 to 5 parts of an Elvacite AB block polymer in about 50 to 70 parts of a solution mixture of styrene/butylmethacylate at the ratio of 20/80 to 50/50; (2) adding 5 to 30 parts of a prepolymer, typically the copolymer of styrene and butyl methacrylate, or styrene and butadiene and 10 to 30 parts of a predispersed magenta pigment powder which is a 50/50 mixture of the magenta pigment and a toner resin, typically the copolymer of styrene and butylmethacrylate, into the block polymer solution; (3) mixing the aforementioned mixture with a mechanical shaker or a roll mill overnight; (4) adding 5 to 15 parts of an oil soluble first shell monomer or monomers and 1 to 5 parts of free radical initiator or initiators to the mixture; (5) mixing the shell monomer(s) and the initiator(s) with the shaker for about 30 minutes to provide a pigment dispersion comprised of all the aforementioned components; (6) dispersing 10 to 20 parts of the dispersion into 50 to 200 parts of an aqueous emulsifier solution, which is comprised of 0.5 to 4 weight percent of an emulsifier, or a combination of more than one emulsifier and an optional phase transfer catalyst in an amount of from about 0.001 to 1 weight percent of the oil shell monomers with a Brinkmann PT45/80 homogenizer equipped with an 35/4G probe at 5,000 to 10,000 rpm for 15 seconds to 5 minutes at 5° to 25° C. to provide an oil-in-water (o/w) suspension; (7) adding to the suspension an aqueous solution of a second shell monomer or monomers containing second shell monomers to encapsulate the core; (8) adding to the resulting suspension from about 0.1 to 100 parts of a 2 percent aqueous protective colloid solution; (9) heating the entire suspension at 75° C. for 15 to 24 hours and then at 85° to 90° C. for 5 to 10 hours to accomplish free radical suspension polymerization of the core monomers and to yield encapsulated particles; (10) washing the particles 10 to 20 times with 600 to 800 parts of deionized water; (11) sieving the washed particles through a combination of 425 and 250 micron sieves; and (12) drying the particles with a Yamato DL-41 spray dryer at an inlet temperature of about 120° to 130° C. thereby yielding free flowing toner particles.

Examples of carrier particles and photoconductive imaging members that can be selected for use with the toner compositions of the present invention are described in U.S. Pat. No. 4,543,313, the disclosure of which is totally incorporated herein by reference. More specifically, illustrative examples of carrier materials that can be selected for mixing with the toner particles obtained by the process of the present invention include those substances that are capable of triboelectrically obtaining a charge of opposite polarity to that of the toner particles. Accordingly, the carrier particles of the present invention are selected so as to be of a negative or positive polarity enabling the toner particles that are positively or negatively charged to adhere to and surround the carrier particles. Specific examples of carriers are granular zircon, granular silicon, methyl methacrylate, glass, steel, nickel, iron ferrites, and the like. The carriers are in some embodiments of the present invention preferably spherical in shape. Generally, from about 2 to about 5 parts per 100 parts by weight of carrier particles are admixed for the formation of the aforesaid developer compositions.

The selected carrier particles can be coated, the coating generally being comprised of fluoropolymers, such as polyvinylidene fluorides, terpolymers of styrene, methyl methacrylate, and a silane, inclusive of triethoxy silane, tetrafluoroethylenes, and the like at, for example, coating weights of from about 0.1 to about 3 weight percent, which coatings are not in close proximity in the triboelectric series, such as those illustrated in copending applications U.S. Ser. Nos. 136,791 and 136,792, the disclosures of which are totally incorporated herein by reference.

The diameter of the carrier particles can vary. Generally, however, it is from about 50 microns to about 1,000 microns allowing these particles to possess sufficient density and inertia to void adherence to the electrostatic images during the development process. The carrier particles can be mixed with the toner particles in various suitable combinations, however, in a preferred embodiment about 1 part per toner to about 10 parts to about 200 parts by weight of carrier are mixed.

Examples of known photoconductive imaging members that can be selected include amorphous selenium, selenium alloys, layered members as illustrated in U.S. Pat. No. 4,265,990, the disclosure of which is totally incorporated herein by reference; and the like.

The following examples are being submitted to further define various species of the present invention. These examples are intended to be illustrative only and are not intended to limit the scope of the present invention. Also, parts and percentages are by weight unless otherwise indicated.

EXAMPLE I

Into a 250 milliliter polypropylene (PP) bottle was added Elvacite pigment dispersant AB 1020 available from E.I. DuPont (2 grams), styrene (70 grams) and butyl methacrylate (BMA, 60 grams). The mixture was then shaken with a Burrel wrist action shaker for about 10 minutes until the AB 1020 was completely dissolved. Predispersed Hostaperm Pink E (48 grams), which is a 50/50 mixture of the aforementioned Hostaperm Pink E pigment, in a styrene-butyl methacrylate polymer, and a 50/50 solution of styrene-butyl methacrylate polymer in styrene (30 grams) were then added to the aforementioned mixture. Thereafter, the resulting mixture was shaken overnight with the above shaker. AIBN (1.5 grams), VAZO 52 (1.5 grams), isophthaloyl chloride (20 grams) and 1,3,5 benzenetricarboxylic acid chloride (10 grams) were then added to the mixture, which was subsequently homogenized with a Brinkmann homogenizer with a 20 TSM generator at 8,000 rpm for 1 minute to provide a pigment dispersion comprised of the aforementioned components. A portion of the pigment dispersion (80 grams) was then added quickly to a homogenizing (8,000 rpm) 2 percent polyvinylalcohol (PVA) (MW (number average molecular weight) of 96,000; 88 percent hydrolyzed) solution (500 milliliters containing 1 gram of KI). Homogenization was continued for 10 seconds to provide an oil-in-water (o/w) suspension, which was then transferred into a 2 liter reaction kettle equipped with mechanical stirrer, condenser, an addition funnel containing 25 percent $K_2CO_3$ (40 milliliters) and a second addition funnel containing 25 percent 2-methyl pentamethylenediamine (40 milliliters) separately. The amine and $K_2CO_3$ solutions were added simultaneously in moderate rates, over a period of less than 1 minute, to the suspension with mechanical stirring (140 rpm). After stirring for 3 hours, a protective colloid solution (1 kilogram, 2 percent Pluronic L43) was added to the suspension. The resulting mixture was then heated at 75° C. for 15 hours and then at 85° C. for 5 hours, and then transferred into a 4 liter beaker. The resulting toner particles comprised of a core containing the passivated pigment, styrene-butyl methacrylate polymer and a shell of polyamide, were washed with water (3 liters × 10), sieved through a combination of 425 and 250 micron sieves, and spray dried to provide the above toner (65 grams, 60 percent) with an average particle diameter size of 16 microns, and GSD of 1.8 as determined by a Coulter Counter.

EXAMPLE II

A portion of the pigment dispersion of Example I (105 grams), was added quickly to a homogenizing (8,000 rpm) 2 percent PVA (MW=96,000; 88 percent hydrolyzed) solution (500 milliliters containing 1 gram of KI). Homogenization was continued for 15 seconds to provide an o/w suspension which was transferred into a 2 liter reaction kettle equipped with mechanical stirrer, condenser, two addition funnels, one of which contained 25 percent $K_2CO_3$ (40 milliliters) and the other 25 percent 2-methyl pentamethylenediamine (40 milliliters). The amine and $K_2CO_3$ solutions were added simultaneously in moderate rates, about 1 minute, to the suspension with stirring mechanically (140 rpm). After stirring for 3 hours, a protective colloid solution (1 kilogram, 2 percent Igepal CO 880) was added. The resulting mixture was then heated at 75° C. for 15 hours, at 85° C. for 5 hours, and then transferred into a 4 liter beaker. The resulting toner product which was comprised of a core of-pigment and styrene-butyl methacrylate polymer and a shell of polyamide was washed with water (3 liters × 10), sieved through a combination of 425 and 250 microns sieves and spray dried to provide a toner (65 grams, 60 percent) with an average particle diameter size of 7.6 μm and GSD of 1.9.

EXAMPLE III

Into a 250 milliliter PP bottle was added DuPont Elvacite block copolymer pigment dispersant AB 1020 (2 grams), styrene (45 grams) and butyl methacrylate (45 grams). The mixture was shaken until AB 1020 was completely dissolved. Predispersed Hostaperm Pink E (40 grams) and a 60/40 solution of styrene-butyl methacrylate polymer in styrene (50 grams) was added. The resulting mixture was shaken overnight with a Burrel wrist action shaker. AIBN (2 grams), VAZO 52 (2 grams), and isophthaloyl chloride (30 grams) were added, and the mixture was homogenized with a Brinkmann homogenizer with a 20 TSM generator at 8,000 rpm for 1 minute to give a pigment dispersion. Portion of the pigment dispersion (65 grams) was added quickly to a homogenizing (8,000 rpm) 4 percent Pluronic F108 solution (500 milliliters containing 10 grams KI). Homogenization was continued for 10 seconds to give an o/w suspension. This was transferred into a 2 liter reaction kettle equipped with mechanical stirrer, condenser, two addition funnels, one of which contained 25 percent $K_2CO_3$ (40 milliliters) and the other 25 percent 2-methyl pentamethylenediamine (40 milliliters). The base and amine solutions were simultaneously added to the suspension with stirring mechanically (140 rpm). After stirring for 3 hours, a protective colloid solution (1 kilogram, 2 percent Igepal CO 970) was added. The resulting mixture was then heated at 75° C. for at least 15 hours, at 85° C. for 5 hours, and then transferred into a 4 liter beaker. The resulting toner was washed with water (3 liters × 10), sieved through a combination of 425 and 250 micron sieves, and spray dried to provide a toner comprised of the core and shell components of Example I (30 grams, 50 percent) with an average particle size diameter of 16 microns, and GSD of 1.8.

EXAMPLE IV

A pigment dispersion of the following composition was prepared substantially as described in Example I: AB 1020 (4 grams), styrene (100 grams), BMA (100 grams), predispersed Hostaperm Pink E (80 grams), a 60/40 solution of a styrene-butyl methacrylate polymer in styrene (100 grams), isophthaloyl chloride (62 grams), AIBN (2 grams), and VAZO 52 (2 grams). A solution of bisphenol A was prepared according to the following procedure. Sodium hydroxide (8 grams) was added into a 150 milliliter PP bottle containing ice water (100 grams). After the sodium hydroxide was solubilized, bisphenol A (22.8 grams), $K_2CO_3$ (10 grams) and benzyltriethyl ammonium chloride (BTEAC, 1.0 gram) were added. The mixture was shaken until a solution was obtained. An emulsifier solution having 4 percent Pluronic F108 and 0.4 percent PVA (MW=3000, 75 percent hydrolyzed) was also prepared. A portion of the above pigment dispersion (90 grams) was added to a homogenizing emulsifier solution (600 grams). Homogenization probe, speed and duration were 35/4G, 7,000 rpm, and 12 seconds, respectively, to give an o/w suspension. This was transferred into a 2 liter reaction kettle and was stirred mechanically. A portion of the above bisphenol A solution (87 grams) was then added. The mixture was stirred for 10 minutes and an additional bisphenol A solution (13 grams) was added. The resulting mixture was stirred at room temperature for 2 hours. A protective colloid solution (1,000 grams, containing 30 grams Igepal CO 887 and 10 grams of KI) was added. The mixture was then heated at 70° to 75° C. for 14 hours and then at 85° C. for 6 hours. The mixture was transferred into a 4 liter beaker and washed with water (3 liters×10), sieved through a combination of 425 and 250 micron sieves and spray dried to provide a toner comprised of the core components of Example I and a shell polyester (40 grams, 60 percent) with an average particle size of 21.0 microns and GSD of 1.8. As determined by a transmission electron microscope, the shell thickness was 0.6 to 1.0 μm (micron) and the passivated pigment particles were evenly dispersed within the core.

EXAMPLE V

A pigment dispersion of the following composition was prepared by repeating the process of Example I; specifically, AB 1020 (3 grams), styrene (50 grams), BMA (50 grams), a 60/40 solution of a styrene-butyl methacrylate polymer in styrene (50 grams), predispersed Hostaperm Pink E (35 grams), isophthaloyl chloride (20 grams), AIBN (1 gram), and VAZO 52 (1 gram). A solution of bisphenol A was prepared according to the following procedure. Potassium hydroxide (14.5 grams) was added into a 250 milliliter PP bottle containing ice water (200 grams). After KOH was solubilized, bisphenol A (25 grams), and $K_2CO_3$ (20 grams) were added. The resulting mixture was shaken to provide a bisphenol solution. An emulsifier solution having 4 percent Pluronic F108 and 0.4 percent PVA (MW=3,000, 75 percent hydrolyzed) was also prepared. The pigment dispersion (91 grams) was added to a homogenizing emulsifier solution (600 grams with 0.65 grams of BTEAC added), and homogenization probe, speed, and duration were 36/2G, 7,000 rpm, and 10 seconds, respectively, to provide an o/w suspension. This suspension was transferred into a 2 liter reaction kettle and was stirred mechanically. A portion of the above bisphenol A solution (35 grams) was then added. The resulting mixture was stirred for 10 minutes and an additional bisphenol A solution (13 grams) was added to the aforementioned mixture. The resulting mixture was stirred at room temperature for 2 hours. A protective colloid solution (900 grams, containing 18 grams Pluronic F 38 and 15 grams KI) was added. The mixture was then heated at 70° to 75° C. for 7 hours and then at 85° C. for 10 hours. The mixture was transferred into a 4 liter beaker and washed with water (3 liters×10), sieved through a combination of 425 and 250 micron sieves and spray dried to provide a toner comprised of the core and shell components of Example IV (58 grams, 60 percent) with an average particle size of 16 μm and a GSD of 1.8.

EXAMPLE VI

An attrited pigment concentrate containing 15 percent of Hostaperm Pink E, 6 percent of a pigment dispersant, and 79 percent of BMA, provided by E.I. DuPont, was used to prepare a pigment dispersion and a toner by substantially repeating the procedure of Example I. The concentrate (100 grams), butyl methacrylate (23 grams) and a 50/50 solution of a styrene-butyl methacrylate polymer in styrene (100 grams) was shaken for 5 hours. Isophthaloyl chloride (13 grams), AIBN (1 gram), and VAZO 52 (1 gram) were then added. A solution of bisphenol A was also prepared according to the following procedure. Sodium hydroxide (8.8 grams) was added into a 150 milliliter PP bottle containing ice water (100 grams). After the KOH had been solubilized, bisphenol A (15 grams) and $K_2CO_3$ (10 grams) were added. The mixture was shaken until a solution was obtained. An emulsifier solution having 4 percent Pluronic F108 and 0.4 percent PVA (MW=96,000, 88 percent hydrolyzed) was also prepared. A portion of the pigment dispersion (95 grams) was added to a homogenizing emulsifier solution with 4 percent Pluronic and 0.4 percent PVA (MW=96,000; 88 percent hydrolyzed) (500 grams, containing 10 grams KI), homogenization probe, speed, and duration were 35/4G, 8,000 rpm, and 30 seconds, respectively, to yield an o/w suspension. This suspension was transferred into a 2 liter reaction kettle and was stirred mechanically. A portion of the above bisphenol A solution (52 grams) was then added to the aforementioned solution. The mixture was stirred for 10 minutes and a solution of t-butylphenol (15 grams, prepared from 5 grams t-butyl phenol, 2.5 grams KOH and 22.5 grams water) was added. The resulting mixture was stirred at room temperature for 1 hour. A protective colloid solution (1,000 grams, containing 20 grams Pluronic F38 and 10 grams KI) was added. The mixture was then heated at 75° C. for 20 hours and then at 85° C. for 4 hours. The resulting mixture was transferred into a 4 liter beaker and washed with water (3 liters×10), sieved through a combination of 425 and 250 μm sieves and spray dried to provide a toner comprised of the core and shell components of Example IV (40 grams, 60 percent) with an average diameter particle size of 13.6 μm (microns) and a GSD of 1.8. As determined by a transmission electron microscope, the shell thickness was 0.1 to 0.4. μm, and the pigment particles were evenly dispersed within the core.

EXAMPLE VII

An attrited pigment concentrate consisting of 30 percent of Novoperm Yellow FGL, 5 percent of a block polymer pigment dispersant, and 65 percent of BMA, provided by DuPont, was used to prepare the pigment dispersion by substantially repeating the procedure of Example I, and wherein a polyester shell was selected. The concentrate (100 grams), a 60/40 solution of a styrene-butyl methacrylate polymer in styrene (100 grams) and butyl methacrylate (23 grams) was shaken for 5 hours. Isophthaloyl chloride (12 grams), AIBN (1 gram), and VAZO 52 (1 gram) were then added and the resulting mixture was shaken for another 30 minutes to provide a pigment dispersion (227 grams total weight). A portion of the prepared pigment dispersion (100 grams) was added to a homogenizing emulsifier solution having 4 percent Pluronic and 0.4 percent PVA (MW=96,000; 88 percent hydrolyzed) (500 grams, containing 10 grams KI). The homogenization probe, speed, and duration were 35/4G, 8,000 rpm, and 30 second, respectively. An o/w suspension resulted. To this o/w was added the bisphenol A solution (49 grams of Example VI) with stirring. The resulting suspension was transferred into a 2 liters reaction kettle and was stirred mechanically. After stirring for 10 minutes, the solution of t-butylphenol (15 grams, prepared from 5 grams t-butyl phenol, 2.5 grams KOH and 22.5 grams water) was added. The resulting mixture was stirred at room temperature for 1 hour. A protective colloid solution (1,000 grams, containing 20 grams Pluronic F38 and 10 grams of KI) was added to the aforementioned mixture. The resulting mixture was then heated at 75° C. for 18 hours and then at 85° C. for 6 hours. The toner product mixture was transferred into a 4 liter beaker and washed with water (3 liters×10), sieved through a combination of 425 and 250 micron sieves and spray dried to provide a toner (65 grams, 62 percent) comprised of a core containing the yellow pigment, and the copolymer of styrene and butyl methacrylate, and a polyester shell. The toner average particle diameter size was 17.8 μm with a GSD was 1.5. According to transmission electron microscope, the shell thickness was 0.1 to 0.4 μm and the pigment particles were evenly dispersed within the core. Fused solid images upon paper were obtained from the toner sample with a hard silicone fuser roll at 300° to 345° F. with substantially no toner offsetting.

EXAMPLE VIII

The yellow pigment concentrate of Example VII (100 grams) was mixed with a 60/40 solution of a styrene-butyl methacrylate polymer in styrene (100 grams) and butyl methacrylate (23 grams) for 5 hours with a shaker, reference Example VII. Isophthaloyl chloride (14 grams), AIBN (1 gram), VAZO 52 (1 gram) were then added and the resulting mixture was shaken for another 30 minutes to yield a pigment dispersion (229 grams total weight). A portion of the yellow pigment dispersion, 100 grams, was added to a homogenizing emulsifier solution having 4 percent Pluronic and 0.4 percent PVA (MW=96,000; 88 percent hydrolyzed) (500 grams, containing 10 grams of KI). The homogenization probe, speed, and duration were 35/4G, 8,000 rpm, and 30 seconds, respectively. There resulted an o/w suspension. To this o/w was added the bisphenol A solution (56 grams of Example VI) with stirring. The resulting suspension was transferred into a 2 liter reaction kettle and was stirred mechanically. After stirring for 10 minutes, the solution of t-butylphenol (15 grams, prepared from 5 grams t-butyl phenol, 2.5 grams KOH and 22.5 grams water) was added to the suspension. The resulting mixture was stirred at room temperature for 1 hour. A protective colloid solution (1,000 grams, containing 20 grams Pluronic F38 and 10 grams of KI) was added. The mixture was then heated at 75° C. for 18 hours and then at 85° C. for 6 hours. The product mixture was transferred into a 4 liter beaker and washed with water (3 liters×10), sieved through a combination of 425 and 250 micron sieves and spray dried to yield a toner comprised of the core and shell components of Example VII (64 grams, 62 percent) with an average particle diameter size of 11.6 μm and GSD of 1.7. The toner sample also fused at 300° to 345° F.

EXAMPLE IX

The yellow pigment concentate of Example VIII (100 grams), a 60/40 solution of a styrene-butyl methacrylate polymer in styrene (100 grams) and butyl methacrylate (23 grams) were shaken for 5 hours. Isophthaloyl chloride (14 grams), benzene tricarboxylic acid chloride (1 gram), AIBN (1 gram), and VAZO 52 (1 gram) were then added and shaken for 30 minutes to yield a pigment dispersion (230 grams total weight). A portion of the pigment dispersion (100 grams) was added to a homogenizing emulsifier solution containing 4 percent Pluronic and 0.4 percent PVA (MW=96,000; 88 percent hydrolyzed) (500 grams, containing 10 grams of KI). The homogenization probe, speed, and duration were 35/4G, 8,000 rpm, and 30 seconds, respectively. There resulted an o/w suspension. To this suspension was added the bisphenol A solution (58 grams of Example VI) all at once with stirring. The resulting suspension was transferred into a 2 liter reaction kettle and was stirred mechanically. After stirring for 10 minutes, the solution of t-butylphenol (15 grams, prepared from 5 grams t-butyl phenol, 2.5 grams KOH and 22.5 grams water) was added. The resulting mixture was stirred at room temperature for 1 hour. A protective colloid solution (1,000 grams, containing 20 grams Pluronic F38 and 10 grams of KI) was added. The mixture was then heated at 75° C. for 18 hours and then at 85° C. for 6 hours. The product mixture was transferred into a 4 liter beaker and washed with water (3 liters×10), sieved through a combination of 425 and 250 micron sieves and spray dried to provide a toner comprised of the core and shell components of Example VII (62 grams, 60 percent) with an average particle diameter size of 12.6 μm and GSD of 1.8. This toner fused at 300° to 345° F.

Other modifications of the present invention may occur to those skilled in the art based upon a reading of the present disclosure, and these modifications are intended to be included within the scope of the present invention.

What is claimed is:

1. A process for the preparation of encapsulated toner compositions which comprises a core dispersion obtained by adding pigment to a monomer, and wherein the pigment is sterically stabilized with a block copolymer dispersant selected from the group consisting of Solsperse, Disperbyk, Elvacite, and mixtures thereof; dispersing the resulting core dispersion into an aqueous solution containing an emulsifier; adding thereto an aqueous solution containing a shell monomer; encapsulating the core dispersion by interfacial polymerization of said shell monomer; and heating to initiate a free radical polymerization of the core monomer.

2. A process for the preparation of encapsulated toner compositions which comprises (1) providing a core composition comprised of a monomer or monomers capable of being polymerized by free radical polymerization, a colorant or pigment and a free radical initiator, a polymer and an oil soluble shell monomer or monomers; (2) dispersing said core composition in an aqueous phase containing an emulsifier, a surfactant, an antifoaming agent, and a phase transfer agent to form a dispersion of discrete particles; (3) adding to said dispersion a water soluble shell monomer or monomers; (4) encapsulating the core particles by accomplishing interfacial copolymerization of the shell monomer or monomers; and (5) heating the resulting aqueous suspension of the encapsulated particles thereby effecting in situ polymerization of the core monomer, or core monomers, and wherein said colorant or pigment is dispersed in a di- or tri-block copolymer selected from the group consisting of block polymers derived from acrylates, methacrylates and vinyl monomers; or block copolymers derived from a hydroxy terminated oligomer and caprolactone from a hydroxy terminated oligomer and acid chloride; or a cyano terminated oligomer.

3. A process in accordance with claim 2 wherein the copolymer contains styrene, vinyl acetate, or acrylonitrile.

4. An encapsulated toner comprised of a core polymer or polymers, pigment or dye particles stabilized with a block copolymer, and an emulsifier, which core is encapsulated in a polymeric shell, and wherein the block copolymer is selected from the group consisting of Solsperse, Disperbyk, Elvacite, and mixtures thereof.

* * * * *